US008069846B2

(12) United States Patent
Watanuki et al.

(10) Patent No.: US 8,069,846 B2
(45) Date of Patent: Dec. 6, 2011

(54) EXHAUST GAS RECIRCULATION VALVE

(75) Inventors: Haruo Watanuki, Tokyo (JP); Satoru Hasegawa, Tokyo (JP); Sotsuo Miyoshi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 230 days.

(21) Appl. No.: 12/518,019

(22) PCT Filed: Sep. 19, 2007

(86) PCT No.: PCT/JP2007/068188

§ 371 (c)(1),
(2), (4) Date: Jun. 5, 2009

(87) PCT Pub. No.: WO2008/081623

PCT Pub. Date: Jul. 10, 2008

(65) Prior Publication Data

US 2010/0313859 A1 Dec. 16, 2010

(30) Foreign Application Priority Data

Dec. 28, 2006 (JP) ..... 2006-355800

(51) Int. Cl.
*F02B 47/08* (2006.01)

(52) U.S. Cl. ..... 123/568.11; 123/568.18

(58) Field of Classification Search ..... 123/568.11, 123/568.18, 568.21
See application file for complete search history.

(56) References Cited

U.S. PATENT DOCUMENTS

| | | | | |
|---|---|---|---|---|
| 6,279,552 | B1 * | 8/2001 | Okada et al. | 123/568.2 |
| 6,473,958 | B2 * | 11/2002 | Miyoshi et al. | 29/557 |
| 6,874,754 | B2 * | 4/2005 | Geib et al. | 251/214 |
| 7,104,523 | B2 * | 9/2006 | Busato et al. | 251/214 |
| 7,600,738 | B2 * | 10/2009 | Hatano et al. | 251/129.19 |
| 2006/0032485 | A1 | 2/2006 | Wilson et al. | |

FOREIGN PATENT DOCUMENTS

| | | | |
|---|---|---|---|
| EP | 1 640 600 | A2 | 3/2006 |
| JP | 2002-285918 | A | 10/2002 |
| JP | 2004-340053 | A | 12/2004 |
| JP | 2006-112419 | A | 4/2006 |
| WO | WO 2006/124292 | A1 | 11/2006 |

* cited by examiner

*Primary Examiner* — Hai Huynh
(74) *Attorney, Agent, or Firm* — Birch, Stewart, Kolasch & Birch, LLP

(57) ABSTRACT

An exhaust gas recirculation valve is fabricated by fitting a valve head 24 and a cover 32 enclosing a valve rod 25 into a supporting section 31 provided at the tip of the valve rod 25, and caulking the supporting section 31 to secure the valve rod 25 and the cover 32 to the supporting section 31.

2 Claims, 3 Drawing Sheets

EXHAUST GAS RECIRCULATION VALVE

TECHNICAL FIELD

The present invention relates to an exhaust gas recirculation valve provided in a recirculation passage of the exhaust gas of an engine.

BACKGROUND ART

In an engine of an automobile vehicle, in order to reduce the NOx contained in the exhaust gas thereof, is provided an exhaust gas recirculation apparatus recirculating the exhaust gas to the intake side thereof. The exhaust gas recirculation passage is provided with an EGR valve ("Exhaust Gas Recirculation" valve), and the EGR valve is opened or closed by control based on the driving information or the like of the engine. If high-temperature exhaust gas is recirculated to the intake side as it is, the efficiency thereof becomes deteriorated, and the high-temperature exhaust gas has an adverse effect on the EGR valve. Thus, the exhaust gas recirculation passage is provided with an EGR cooler for cooling the high-temperature exhaust gas.

Exhaust gas passing through an EGR valve contains sulfur oxides coming from a fuel system, and nitrogen oxides and particulate matter (PM) such as soot and the like which are produced by combustion. Therefore, those substances are also introduced in the exhaust gas recirculation passage, and they adhere to a valve rod of the EGR valve. When the soot and the like are deposited over the valve rod (the matter deposited thereover is referred to as "deposit"), they can cause trouble in normal operation of the valve rod. In order to solve the troubles caused by the adhesion of the particulate matter to the valve rod, a technology is disclosed, in which a first sleeve enclosing a valve rod is provided integral with a valve disk provided at the tip of the valve rod and further a second sleeve located within the first sleeve is provided on the housing side (Patent Document 1).

Patent Document 1: JP-A-2002-285918

However, the technology disclosed in Patent Document 1 requires that the valve disk have a special shape in order to attach the first sleeve thereto. Further, it is necessary to install the first sleeve on the valve disk separately from the installation of the valve disk on the valve rod, resulting in increasing one manufacturing step.

The present invention has been accomplished to solve such a technical situation, and an object thereof is to provide a structure in which a cover enclosing a valve rod of an EGR valve can be manufactured in a more compact structure and in a simpler process.

DISCLOSURE OF THE INVENTION

The present invention is an EGR valve provided in an exhaust gas recirculation passage for recirculating the exhaust gas of an engine, and the EGR valve is characterized in that a valve head and a cover enclosing a valve rod, which has a turn around the circular area thereof contacting the valve rod, are fitted in a valve head supporting section of the valve rod, and the valve head and the cover are secured to the supporting section by caulking the supporting section.

According to the EGR valve in accordance with the present invention, the valve head supporting section is caulked together with the valve head and the cover enclosing a valve rod, which has a turn around the circular area thereof contacting the valve rod, to secure the valve head and the cover to the supporting section, and thus the EGR valve comes to have an extremely simple structure and the manufacturing process thereof is also simplified.

BEST MODE FOR CARRYING OUT THE INVENTION

Embodiments of the present invention will now be described with reference to the accompanying drawings in order to explain the present invention in more detail.

First Embodiment

Figure 1:
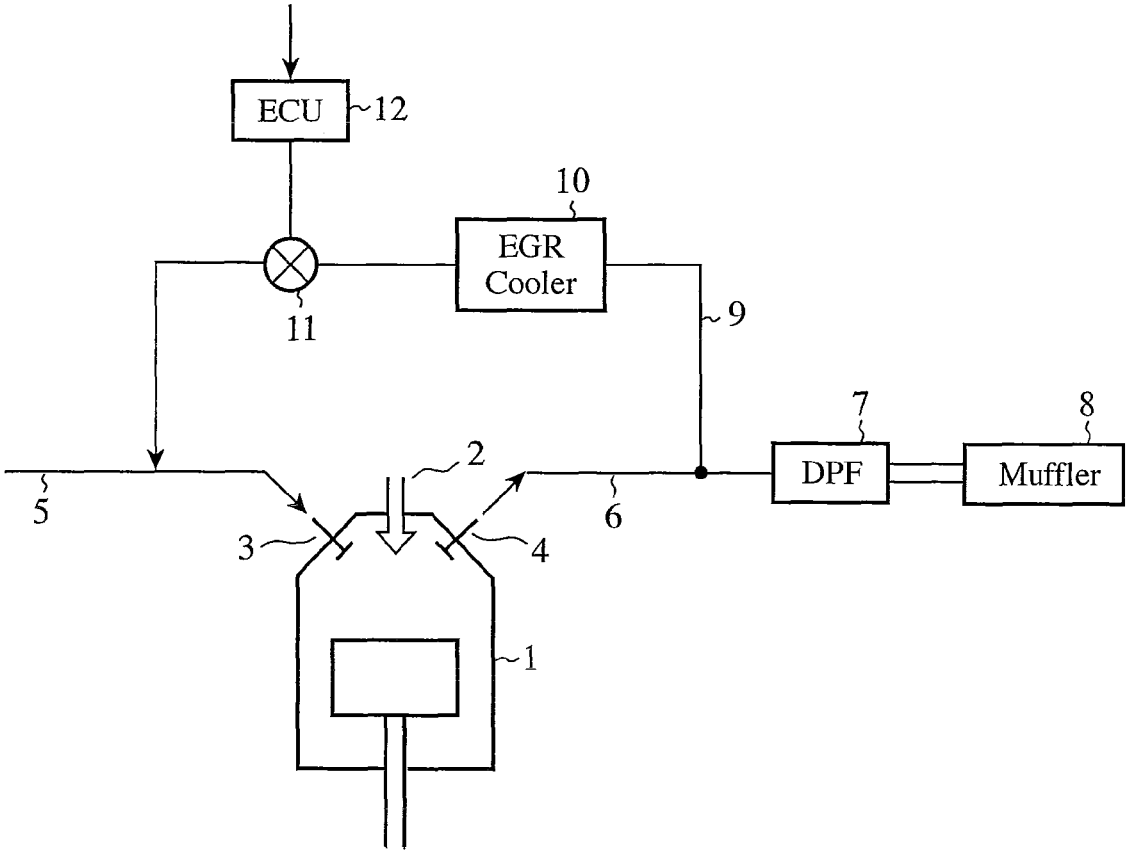
FIG. 1 is a schematic view of an engine equipped with an EGR valve to which the present invention is applied.
Figure 2:
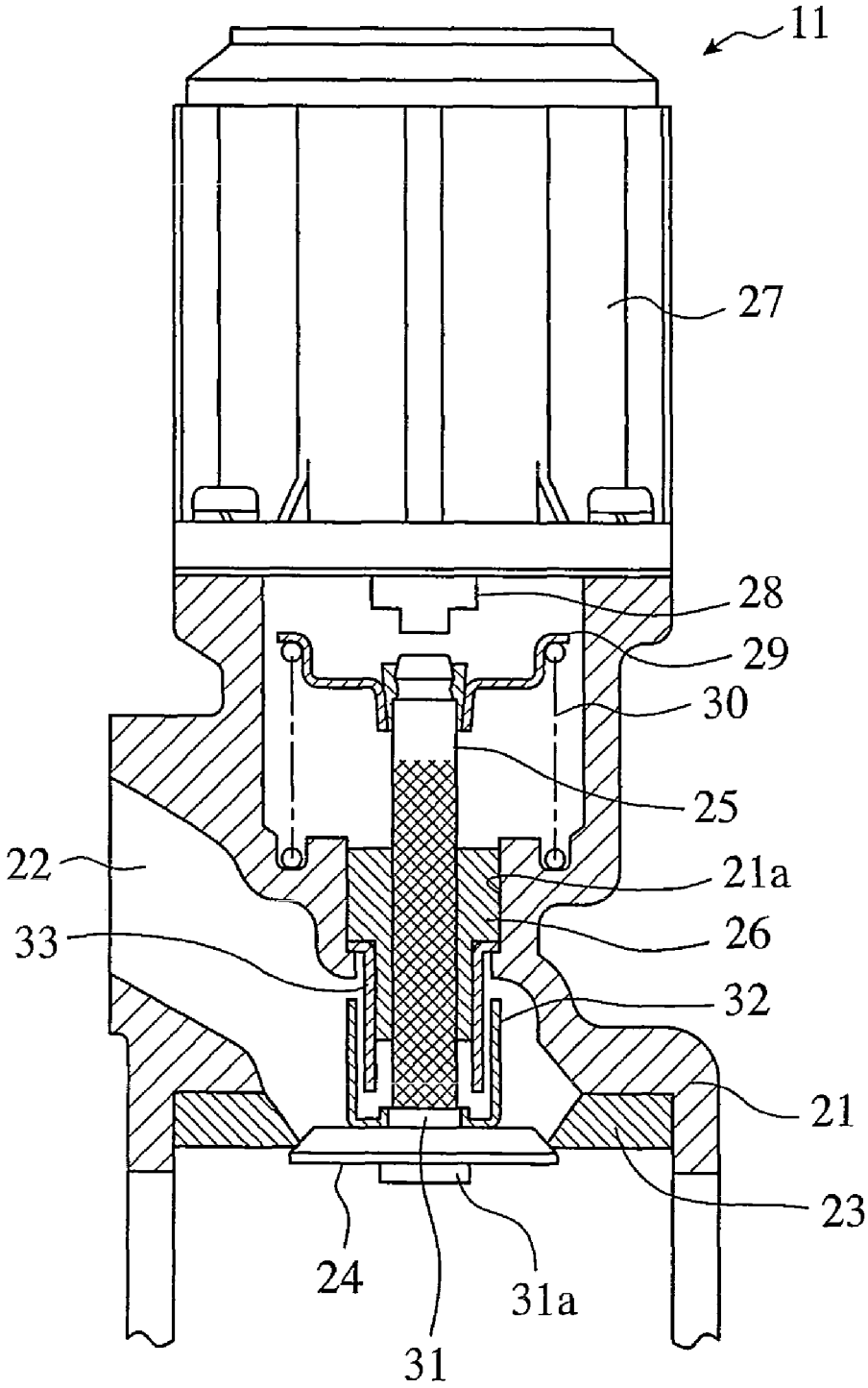
FIG. 2 is a sectional view of an EGR valve according to the first embodiment of the present invention.
Figure 3:
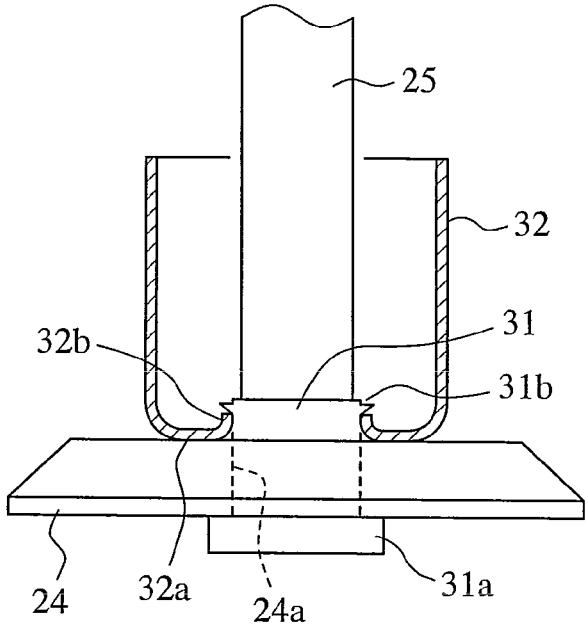
FIG. 3 is an enlarged view of a first cover portion of the EGR valve in FIG. 2.
Figure 4:
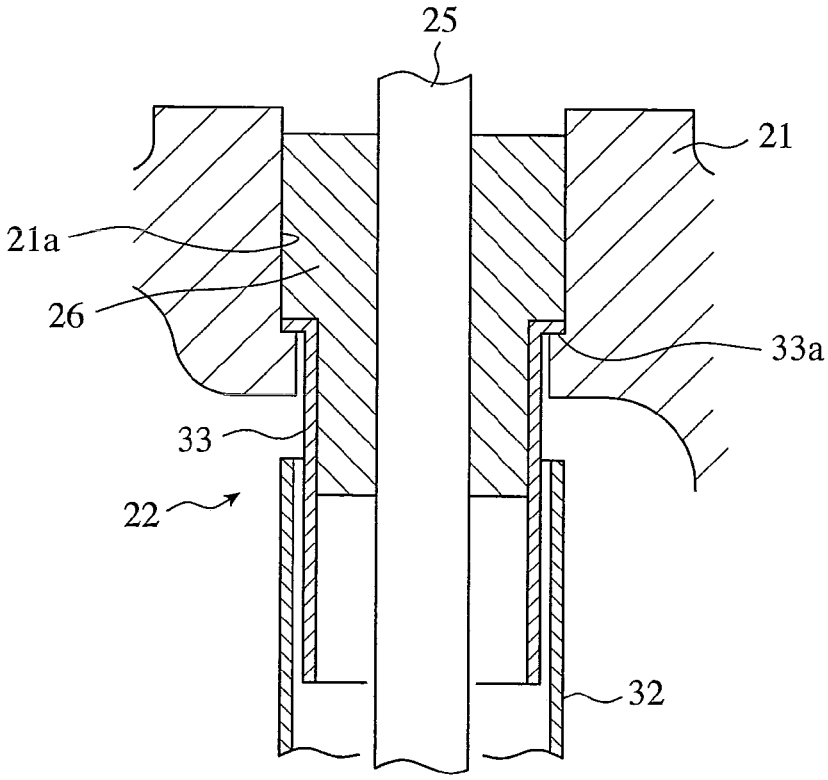
FIG. 4 is an enlarged view of a second cover portion of the EGR valve in FIG. 2.

FIG. 1 is a schematic view of an engine equipped with an EGR valve and an EGR cooler, and FIG. 2 is a sectional view of an EGR valve according to the first embodiment of the present invention.

First, the outline as an objective engine in the present invention will be discussed. A diesel engine 1 has a fuel injection nozzle 2 facing a combustion chamber, and the chamber is provided with an inlet valve 3 taking in air to the combustion chamber and an exhaust valve 4 exhausting combustion gas generated in the combustion chamber therefrom. The inlet valve 3 has an intake passage 5 connected thereto and the exhaust valve 4 has an exhaust passage 6 connected therewith. The exhaust passage 6 is provided with a DPF filter 7 for removing particulate matter (PM) contained in the exhaust gas and further is provided with a muffler 8. The exhaust passage is provided with an exhaust gas recirculation passage 9 that is branched from the exhaust passage 6 and connected with the intake side thereof, and the exhaust gas recirculation passage 9 is provided with an EGR cooler 10 and an EGR valve 11. The EGR cooler 10 has a structure for cooling the exhaust gas by a water cooling system. The EGR valve 11 is controlled by an electronic control unit (ECU) 12. The EGR valve 11 controls the flow of the exhaust gas cooled by the EGR cooler 10 based on a variety of information such that the exhaust gas is supplied in an optimum amount to the intake side thereof.

As shown in FIG. 2, in the EGR valve 11, a valve housing 21 forming the main body is provided with an exhaust gas passage 22 for introducing the exhaust gas cooled by the EGR cooler 10 to the intake side; the exhaust gas passage 22 is provided with a valve seat 23 formed at the halfway position of the passage; and the exhaust gas passage is further provided with a valve head (valve disk) 24 opening and closing the exhaust gas passage 22 by engaging and disengaging the valve seat 23. The valve head 24 is provided on the tip of a valve rod 25 by press-fitting or the like. The valve rod 25 is axially slidably supported by a bearing section 26 assembled in the valve housing 21.

The rear end of the valve rod 25 is opposed to the tip of a rod 28 of an actuator 27 provided on the valve housing 21. The actuator 27 is driven and controlled by commands from the electronic control unit (see FIG. 1). The valve rod 25 has a spring holder 29 attached on the upper portion thereof, and provided between the spring holder 29 and the valve housing 21 is a spring 30 exerting a spring force on the valve rod 25 to cause the valve head 24 to engage the valve seat 23. The electronic control unit operates the actuator 27 to cause the rod 28 to axially press the valve rod 25, and thereby, the valve head 24 is separated from the valve seat 23, thus opening the valve. The rod 28 of the actuator 27 returns by a restoring force of the spring 30, thus engaging the valve head 24 to the valve seat 23.

The end portion of the valve rod 25 is provided with a supporting section 31 having a flange 31*a* at the tip and having an external diameter larger than that of the valve rod 25. The valve rod 25 is inserted through the valve head 24 having a hole 24*a* through the center thereof and a first cover 32 that is cylindrical and has a turn 32*b* at the bottom section 32*a* thereof, from the side opposite to the valve head supporting section 31 of the valve rod 25, and then the valve head 24 and the first cover 32 are press-fitted on the supporting section 31, through the hole 24*a* and the internal diameter portion of the turn, respectively. The valve head 24 is placed in a sandwiched state between the flange 31*a* and the first cover 32. In this state, the edge of the supporting section 31 is caulked such that a caulking section 31*b* thereof abuts against the end of the turn 32*b*, and thereby the first cover 32 is secured thereto. Consequently, the valve head 24 is also fixed thereon together with the first cover 32.

Secured to the valve housing 21 is a second cover 33 located within the first cover 32. The second cover 33 is cylindrical and has an outwardly projecting flange 33*a* at the top. The second cover 33 is attached within a hole 21*a* which is provided through the valve housing 21 and to which the bearing 26 is secured, and the second cover, when the bearing 26 is secured in the valve housing 21 by press-fitting or the like, is fixed thereon by the flange 33*a* being interposed between the bearing 26 and the valve housing 21.

The first cover 32 and the second cover 33 are formed of metal such as stainless steel, or those covers are formed of steel and are given chromium plating or the equivalent over the surface.

Soot and the like contained in the exhaust gas flowing through the exhaust gas passage 22 are blocked by the first cover 32 and the second cover 33, and hardly reach the valve rod 25. Thus, the valve rod 25 does not cause malfunction because of the adhesion of the soot and the like thereto.

According to the EGR valve according to the first embodiment, the EGR valve is fabricated by press-fitting the first cover 32 on the valve head supporting section 31 of the valve rod 25 together with the valve head 24, and then securing the cover and the valve head thereto by caulking, and thus the structure of the EGR valve is simplified. Further, in the fabrication, the valve head 24 and the first cover 32 are fitted into, press-fitted on the valve head supporting section 31 of the valve rod 25 from the same direction and the valve head supporting section is caulked, thus also simplifying the manufacturing process.

It should be appreciated that in the first embodiment, the turn 32*b* of the first cover 32 may be removed. In that case, the internal diameter section of the bottom 32*a* is press-fitted on the supporting section 31, and the bottom 32*a* is secured thereto by caulking the edge of the supporting section 31. Moreover, the bottom 32*a* does not have to be annular, and the bottom may be provided by inwardly protruding a plurality of bottoms each being shaped like a nail.

INDUSTRIAL APPLICABILITY

As mentioned above, the exhaust gas recirculation valve according to the present invention is extremely simplified in the construction by virtue of a valve head and a cover enclosing a valve rod being secured together to a valve head supporting section, simplifying also the manufacturing process thereof. Thus the exhaust gas recirculation valve is suitable for an exhaust gas recirculation valve provided in a recirculation passage of the exhaust gas of an engine, for instance.

The invention claimed is:

1. An exhaust gas recirculation valve that is an exhaust gas recirculation valve provided in an exhaust gas recirculation passage for recirculating the exhaust gas of an engine, wherein a valve head and a cover enclosing a valve rod are fitted to a valve head supporting section of the valve rod, the cover having a bent portion formed by bending a circular area thereof contacting the valve head supporting section, and the valve head and the cover are secured to the supporting section by caulking the supporting section.

2. The exhaust gas recirculation valve according to claim 1, wherein another cover secured on the valve housing side of the valve and enclosing the valve rod is located within the cover.

* * * * *